US005348848A

United States Patent [19]

Murakami et al.

[11] Patent Number: 5,348,848

[45] Date of Patent: Sep. 20, 1994

[54] METHOD OF MANUFACTURING SILVER HALIDE PHOTOGRAPHIC EMULSION AND SILVER HALIDE PHOTOGRAPHIC LIGHT-SENSITIVE MATERIAL COMPRISING THE SILVER HALIDE PHOTOGRAPHIC EMULSION

[75] Inventors: Shuji Murakami; Shigeo Tanaka, both of Tokyo, Japan

[73] Assignee: Konica Corporation, Tokyo, Japan

[21] Appl. No.: 37,236

[22] Filed: Mar. 26, 1993

[30] Foreign Application Priority Data

Apr. 3, 1992 [JP] Japan ..... 4-82250

[51] Int. Cl.[5] ..... G03C 1/015; G03C 1/09

[52] U.S. Cl. ..... 430/569; 430/604; 430/608

[58] Field of Search ..... 430/567, 569, 604, 608

[56] References Cited

U.S. PATENT DOCUMENTS

| | | | |
|---|---|---|---|
| 4,183,756 | 1/1980 | Locker | 430/569 |
| 4,225,666 | 9/1980 | Locker | 430/569 |
| 4,806,462 | 2/1989 | Yamashita et al. | 430/604 |
| 5,051,344 | 9/1991 | Kuno | 430/605 |
| 5,057,402 | 10/1991 | Shiba et al. | 430/604 |
| 5,213,953 | 5/1993 | Yamamoto | 430/605 |

FOREIGN PATENT DOCUMENTS

| | | | |
|---|---|---|---|
| 0318987 | 6/1989 | European Pat. Off. . | |
| 0350046 | 1/1990 | European Pat. Off. . | |
| 439041 | 7/1991 | European Pat. Off. | 430/604 |
| 4-56948 | 2/1992 | Japan | 430/604 |
| 4125629 | 4/1992 | Japan . | |
| 2130389 | 5/1984 | United Kingdom . | |

OTHER PUBLICATIONS

Database WPIL, Week 8545, Derwent Publications Ltd., London, GB; AN 85-280545 & JP-A-60 191 239 (Konishiroku Photo KK) Sep. 28, 1985 *abstract*.

Patent Abstracts of Japan, vol. 16, No. 251 (P-1366) June 8, 1992 & JP-A-40 56 948 (Konica Corp.) Feb. 24, 1992 *abstract*.

Patent Abstracts of Japan, vol. 16, No. 386 (P-1404) Aug. 18, 1992 & JP-A-41-25 629 (Konica Corp.) Apr. 27, 1992 *abstract*.

*Primary Examiner*—Janet C. Baxter

*Attorney, Agent, or Firm*—Frishauf, Holtz, Goodman & Woodward

[57] ABSTRACT

A silver halide photographic light-sensitive material comprising a support and provided thereon, a silver halide emulsion layer comprising silver halide grains containing at least one substance selected from the group consisting gallium, germanium, indium, thallium and compounds thereof.

16 Claims, No Drawings

METHOD OF MANUFACTURING SILVER HALIDE PHOTOGRAPHIC EMULSION AND SILVER HALIDE PHOTOGRAPHIC LIGHT-SENSITIVE MATERIAL COMPRISING THE SILVER HALIDE PHOTOGRAPHIC EMULSION

FIELD OF THE INVENTION

The present invention relates to a silver halide photographic light-sensitive material, more specifically to a highly sensitive silver halide phonographic light-sensitive material with improved reciprocity law characteristics and reduced latent image regression.

BACKGROUND OF THE INVENTION

In recent years, a rapidly-processable color light-sensitive print material has been demanded in order to finish a large number of prints in a short time. In one known method, rapid color developing is achieved by using as silver halide emulsion a silver chloride emulsion or a silver chlorobromide emulsion having a high silver chloride content, This method is disclosed, for example, in U.S. Pat. Nos. 4,183,756 and 4,225,666 and Japanese Patent Publication Open Public Inspection (hereinafter referred to as Japanese Patent O.P.I. Publication) Nos. 26589/1980, 91444/1983, 95339/1983, 94340/1983, 95736/1983, 106538/1983, 107531/1983, 107532/1983, 107533/1983, 108533/1983, and 125612/1983.

However, silver chloride emulsion and silver chlorobromide emulsion having a high silver chloride content have problems such as large fogging, low sensitivity and poor reciprocity law characteristics, that is, sensitivity and gradation greatly vary depending on exposure illumination intensity.

For this reason, various methods have been proposed in order to overcome the above problems. Examples are disclosed, for example, in Japanese Patent O.P.I. Publication Nos. 13932/1976 and 171947/1984 in which processing stability and reciprocity law characteristics are improved by introducing a compound containing a metal belonging to the group VIII of the periodic table. Such methods, however, do not adequately solve the problems arising from the use of silver chloride or silver halide of high silver chloride content.

A method is disclosed in Japanese Patent O.P.I. Publication No. 183647/1989 in which iron ions are added to the silver chloride rich silver halide having a silver bromide phase of high silver bromide content in order to realize high sensitivity, improved reciprocity law characteristics, and reduced change in sensitivity and gradation caused by temperature changes during exposure. Although this method does solve the aforementioned problems, when the time from exposure to processing is long, sensitivity greatly varies, that is, stability of the latent image is greatly lowered.

Zwicky disclosed on page 201 in volume 3 of the Journal of Photographic Science that to dope into an emulsion iridium compounds, which is well known as a reciprocity law improving agent certainly improves reciprocity law characteristics, but markedly reduces the stability of a latent image, thereby manufacturing this method not very practical.

Further, Japanese Patent O.P.I. Publication No. 135832/1980 discloses a method in which high sensitivity and improved reciprocity law characteristics are simultaneously achieved by doping cadmium, lead, copper, and zinc. The present inventors have examined this method, and have found that high sensitivity and improved reciprocity law characteristics were not simultaneously obtained.

Japanese Patent O.P.I. Publication No. 20852/1990 discloses a silver halide emulsion which contains a transition metal having a nitrosyl or thionitrosyl ligand. Such transition metals, however, desensitize the emulsion.

Japanese Patent O.P.I. Publication Nos. 20853/1990 and 20855/1990 disclose methods in which high sensitivity is realized by adding a complex comprising a cyano ligand. The cyano ligand, however, is highly toxic and pollutes the environment, thereby manufacturing this method impractical.

SUMMARY OF THE INVENTION

Accordingly, the object of the present invention provide a silver halide photographic light-sensitive material with high sensitivity, improved reciprocity characteristics as well as reduced latent image regression.

DETAILED DESCRIPTION OF THE INTENTION

The foregoing object of the invention is achieved by a method of manufacturing a silver halide photographic emulsion containing silver halide grains comprising forming the silver halide grains in the presence of at least one substance selected from the group consisting of gallium, germanium, indium and compounds thereof; and a silver halide photographic light-sensitive material comprising at least one light-sensitive layer having a silver halide emulsion, wherein the silver halide emulsion contains at least one of gallium, germanium, iridium and a compound thereof.

It is a preferred embodiment of the invention that, the halide composition of silver halide grains in the silver halide emulsion is silver chlorobromide having a silver chloride content of not less than 90 mol % and containing virtually no silver iodide, wherein the grains comprise localized silver bromide phase having a silver bromide content of 10 to 90 mol % at an inner phase internally or on the surface, and contains at least one of gallium, germanium, indium, thallium and a compound thereof. This is because the effect of the invention is brought out more positively.

The present invention is hereunder described in detail.

In the invention, the phrase, "forming the silver halide grains in the presence of at least one substance selected from the group consisting of gallium, germanium, indium and compounds thereof" means that the elements or the compound may be introduced before grain formation into a reaction vessel, or added successively or at once during grain formation. It is preferable that the compound of the invention is present within the grains.

In the silver halide photographic light-sensitive material of the present invention (hereinafter occasionally referred to as simply "light-sensitive material"), preferable grains for the effective embodiment of the invention are silver chlorobromide grains having a silver chloride content of 90 mol % or more, preferably not less than 95 mol %, more preferably 98 to 99.9 mol %, and still more preferably 99.3 to 99.9 mol %, and containing substantially no iodide.

The silver halide grains of the present invention may have a uniform composition, but preferably each grain has a localized silver bromide phase at an internal phase or on the surface. The grains may be mixed with other silver halide grains of different composition.

In the silver halide emulsion layer containing silver halide grains having a silver chloride content of not less than 90 mol %, the silver halide grains containing not less than 90 mol % silver chloride content are contained in an amount of preferably not less than 60 mol %, and particularly not less than 80 mol % of the total silver halide grains in the emulsion layer.

The silver halide grains may be of any size, but from the viewpoint of rapid processing, high sensitivity, and other photographic properties the grain size is preferably in the range of 0.2 to 1.6 μm, and more preferably in the range of 0.25 to 1.2 μm. The grain size can be measured using any of various conventional methods used in the art. Typical methods are disclosed in "Grain Size Analysis," by Loveland (A.S.T.M. Symposium on Light Microscopy, 1955, pp. 94~122) and "Theory of Photographic Process," by Meath and James (published by Macmillan Publishing Co., 1966, 3rd edition, chapter 2).

The grain size can be determined from the projected area of grain or approximate grain diameter. The grain size distribution of grains having essentially a uniform shape can be measured quite accurately from the diameter and projected area of grain.

The grain size distribution of the silver halide grains may be either polydispersed or monodispersed, with preference given to a monodispersed silver halide grain having a grain size distribution defined by a coefficient of variation of not more than 0.22, more preferably not more than 0.15. Here, the coefficient of variation is a coefficient which indicates the extent of grain size distribution and is defined by the following formula:

Coefficient of variation = S/R (where S is the standard deviation of grain size distribution, and R the average grain size.)

Here, the size of a spherical silver halide grain is defined by its diameter and that of a cubic and other nonspherical grains is defined by the diameter equivalent to the area of a disk formed by the projected area of grain.

Various equipment and methods known in the photographic industry may be used to prepare a silver halide emulsion.

The silver halide emulsion of the present invention may be prepared by the acidic method, the neutral method, or the ammonical method. The grains may be grown all at once or grown after seed grain formation. The same or different methods may be used to prepare and grow seed grains. As a mode of reacting soluble silver salt with soluble halide compound, the normal precipitation method, the reverse precipitation method, or the simultaneous precipitation method may be used singly or in combination, with preference given to the simultaneous precipitation method. Further, as a mode of the simultaneous precipitation method, a usable method is the pAg controlled double jet method, which is disclosed, for example, in Japanese Patent O.P.I. Publication No. 48521/1979.

Examples of equipment which may be used include: (1) An equipment whose nozzles in reacting mother liquor supply an aqueous solution of water-soluble silver salt and that of a water-soluble halide, disclosed in, for example, Japanese Patent O.P.I. Publication Nos. 92523/1982 and 92524/1982, (2) an equipment which adds an aqueous solution of water-soluble silver salt and that of water-soluble halide while successively changing the concentration, disclosed in, for example, German Patent No. 2921164, and (3) an equipment which forms grains by taking out the reacting mother liquor out of reaction vessel and concentrating the liquor by superfilteration, while keeping the distance among forming silver halide grains constant, disclosed in, for example, Japanese Patent Examined Publication No. 501776/1981. If necessary, a silver halide solvent such as thioether may also be used. Further, a compound containing mercapto group, a nitrogen-containing heterocyclic compound, or a sensitizing dye compound may be added either during silver halide grain formation or after completion of grain formation.

The silver halide grain of the present invention may have any shape. A preferred shape is a cube having 100 planes forming a crystal surface. It is also possible to use an octahedral, tetradecahedral, dodecahedral, or other grain forms prepared by the methods disclosed in U.S. Pat. Nos. 4,183,756 and 4,225,666, Japanese Patent O.P.I. Publication No. 26589/1980, Japanese Patent Examined Publication No. 42737/1980, the Journal of Photographic Science, pp. 21 and 39 (1973), and other documents. Grains having twin crystal planes may also be used. The silver halide grains may have a uniform shape or a combination of various shapes.

During formation of the silver halide grains and/or growth of the silver halide grains in the invention, metal ions may be incorporated at an internal phase in and/or on the surface of the grains by adding a cadmium salt, a zinc salt, a lead salt or a complex salt thereof, a thallium salt, a rhodium salt or complex salt thereof, an iron salt, or an iridium salt or complex salt thereof, with preference given to an iridium salt or an iron salt. Also, a reduction sensitization speck can be provided in and/or on the grains by subjecting the grains to a reducing atmosphere.

The unnecessary soluble salts contained in the silver halide grains in the emulsion may be removed from or retained in the grains after completion of silver halide grain growth. In the former case, the salts are removed by the method disclosed in Research Disclosure No. 17643.

The silver halide grains used in the emulsion may be grains with which latent images are formed mainly on the grain surface, or grains with which latent images are mainly formed therein, with preference given to grains with which latent images are mainly formed on the grain surface.

The emulsion can be optically sensitized to the desired wavelength using a sensitizing dye. Sensitizing dyes which may be used include cyanine dyes, merocyanine dyes, complex cyanine dyes, complex merocyanine dyes, holopolar cyanine dyes, hemicyanine dyes, styrl dyes, and hemioxanol dyes.

Methods which may be used singly or in combination to sensitize the silver halide emulsion include those which use a reducing substance, a chalcogen sensitizer, or a noble metal compound, but sulfur sensitization, gold sensitization, and gold-sulfur sensitization (combination of sulfur and gold sensitization methods) are given particular preference in the invention.

Chalcogen sensitizers which may be used include sulfur sensitizer, selenium sensitizer, and tellurium sensitizer, with preference given to sulfur sensitizer. Examples of sulfur sensitizers include thiosulfate salt, arylthiocarbamide, thiourea, arylisothianate, cystine, p-toluenethiosulfonate salt, and rhodanine.

As a noble metal sensitizer, gold sensitizer is preferred. The gold sensitizer which may be used include those having an oxidation number of 1 or 3 such as chloroauric acid and potassium chloroaurate.

In the invention, the silver halide grains comprise at least one of gallium, germanium, inidium or a salt thereof, with preference given to gallium and germanium, and particular preference given to gallium.

Examples of compounds (referred to as I) which are present during formation of the silver halide grain of the invention are given below, but the scope of the invention is not limited to these compounds.

Examples include: (1) $GaCl_3$, (2) $GaCl_2$, (3)$Ga(NO_3)_3$, (4) $Ga_2O_3$, (5) Ga, (6) $GeCl_4$, (7) $GeO_4$, (8) Ge, (9) $INCl_3$, (10) $KInCl_4$, (11) $In(OH)_3$, (12) $In_2(SO_4)_3$, (13) $In_2O_4$, (14) In, (15) TlCl, and (16) $K_3TlCl_6$.

These compounds I are used in an amount of $10^{-9}$ to 10 mol per mol of silver, and preferably $10^{-7}$ to $10^{-4}$ mol per mol of silver.

When the light-sensitive material of the invention to be used is a color light-sensitive material, it is a common practice to select a dye-forming coupler which forms a dye that absorbs the spectral band the emulsion layer having the coupler is sensitive to. Accordingly, a yellow dye-forming coupler is used in a blue-sensitive emulsion layer, a magenta dye-forming coupler in a green-sensitive emulsion layer, and a cyan dye-forming coupler in a red-sensitive emulsion layer. However, other coupler-emulsion combinations may be used to prepare a color light-sensitive material suited to the purposes.

The light-sensitive material of the invention may incorporate an anti-foggant, an image stabilizer, a hardener, a plasticizer, an anti-irradiation dye, a polymer latex, an ultraviolet absorbent, a formalin scavenger, a developing accelerator, a developing retarder, a brightening agent, a matting agent, a lubricant, an antistatic agent, a surfactant, or other additives. Compounds thereof are described, for example, in Japanese Patent O.P.I. Publication Nos. 215272/1987 and 46436/1988.

The light-sensitive material of the invention may be used to form an image by a color developing method known in the photographic industry.

EXAMPLES

Examples of the invention are described below, but the scope of the invention is not limited to these examples. The term "AgX" means silver halide.

Example 1

To one liter of a 2% aqueous gelatin solution kept at 40° C., the following solutions A and B were added simultaneously in 30 minutes, with pAg controlled at 6.5 and pH at 3.0. Then, the following solutions C and D were added simultaneously in 120 minutes, with the pAg controlled at 7.3 and the pH at 5.5.

The pAg was controlled according to a method disclosed in Japanese Patent O.P.I. Publication No. 45437/1984. The pH was controlled with an aqueous sulfuric acid or sodium hydroxide solution.

| | |
|---|---|
| (Solution A) | |
| Sodium chloride | 3.42 g |
| Potassium bromide | 0.03 g |
| Water was added to 200 ml. | |
| (Solution B) | |
| Silver nitrate | 10 g |
| Water was added to 200 ml. | |
| (Solution C) | |
| Sodium chloride | 78.7 g |
| Potassium bromide | 0.157 g |
| Water was added to 446 ml. | |
| (Solution D) | |
| Silver nitrate | 190 g |
| Water was added to 380 ml. | |

After adding the above solutions, the resulting mixture was desalinized with a 10% aqueous solution of Demol N, a product of Kao Atlas, and a 30% aqueous magnesium sulfate solution, and then mixed with an aqueous solution of gelatin in order to obtain a monodispersed emulsion EMP-1 comprising cubic grains having an average grain size of 0.40 μm, a coefficient of variation of 0.07, and a silver chloride content of 99.9 mol %.

EMP-1 was optimally sensitized at 65° C. using the following compounds to prepare a green-sensitive silver halide emulsion Em-1.

| | |
|---|---|
| Sodium thiosulfate | 1.5 mg/mol of AgX |
| Stabilizer SB-1 | $6 \times 10^{-4}$ mol/mol of AgX |
| Sensitizing dye GS-1 | $3 \times 10^{-4}$ mol/mol of AgX |

SB-1: 1-(3-acetamidophenol)-5-mercaptotetrazole

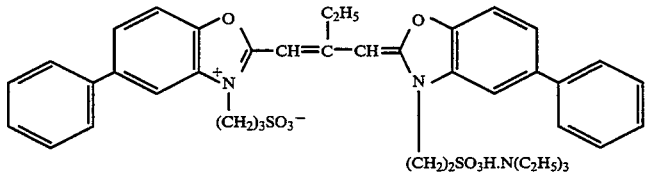

Next, Em-2 was prepared in the same way as in Em-1, except that $K_2IrCl_6$ was added to solution C in an amount of $4\times10^{-8}$ mol per mol of silver.

Em-3 was prepared in the same way as in Em-1, except that compound No. I-3 of the invention was added to solution C in an amount of $5\times10^{-5}$ mol per mol of silver.

Em-4 and Em-5 were prepared in the same way as in Em-3, except that I-9 and 1-15 were respectively added instead of I-3, each in the same amount as I-3, and that $K_2IrCl_6$ to solution C in an amount of $4\times10^{-8}$ mol per mol of silver.

Em-6 was prepared in the same way as in Em-3, except that $K_2IrCl_6$ was added to solution C in an amount of $4\times10^{-8}$ mol per mol of silver.

Em-7 and Em-8 were prepared in the same way as in Em-6, except that IR-1 and IR-2 were respectively added instead of I-3 as comparative examples, each in the same amount as I-3.

IR-1: $ZnCl_2$

IR-2: $K_3(RuCl_5NO)$

The layers with the following compositions were formed by coating on a paper support having polyethylene lamination on one face and polyethylene lamination containing titanium oxide on the other (photographic composition layer side) to obtain a monochromatic color light-sensitive material sample No. 101.

TABLE 1

| Layer | Composition | Coating weight ($g/m^2$) |
|---|---|---|
| 2nd layer | Gelatin | 1.00 |
| 1st layer | Gelatin | |
| (green-sensitive | Em-1 | 0.36* |
| layer) | Magenta coupler (M-1) | 0.35 |
| | Dye-image stabilizer (ST-3) | 0.15 |
| | Dye-image stabilizer (ST-4) | 0.15 |
| | Dye-image stabilizer (ST-5) | 0.15 |
| | TOP | 0.20 |
| Support | Polyethylene laminated paper | |

*Expressed as amount converted to silver.
ST-3: 1,4-dibutoxy-2,5-di-t-butylbenzene
ST-4: 4-(4-hexyloxyphenyl)thiomorpholine-1-dioxide
ST-5: 1,1-bis(2-methyl-4-hydroxy-5-t-butylphenyl)butane
TOP: Trioctylphosphate

M-1

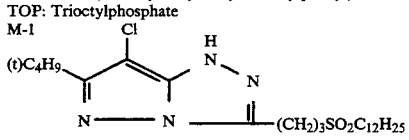

As a hardener, H-1 was added to the 2nd layer.

H-1: 2,4-dichloro-6-hydroxy-s-triazine.sodium

Sample Nos. 102 to 108 were prepared in the same way as in sample No. 101, except that Em-2 through Em-8 were used respectively in place of Em-1.

Each of the obtained samples was evaluated for photographic performance using the following methods.

Sensitometry

After exposed to green light for 0.05 seconds through an optical wedge, each sample was subjected to color development according to the following process. Then, the density of the sample was measured using an optical densitometer PDA-65 (product of Konica Corp.), and then was expressed as the logarithm of the reciprocal of exposure necessary to obtain a density 0.8 higher than fog density. Sensitivity of the sample was expressed as a sensitivity relative to a sensitivity of sample 101 defined as 100.

Reciprocity law failure characteristics

After exposed to the same amount of green light as in the above sensitometry through an optical wedge for 10 seconds, each sample was subjected to sensitometry in the same way as above. Reciprocity law failure characteristic was expressed as a sensitivity at 100 second exposure relative to a sensitivity at 0.05 second exposure defined as 100.

Fog density

After color development of unexposed samples, the density of the samples was measured using the optical densitometer PDA-65 (product of Konica Corp.).

Stability of latent image

After exposed to green light for 10 seconds or 5 minutes, each of the samples was subjected to development. Then, the density of each was measured using the optical densitometer PDA-65 (product of Konica Corp.), and then was expressed as the logarithm of the reciprocal of exposure necessary to obtain a density 0.8 higher than fog density. Latent image stability was expressed as a sensitivity of a sample developed at 5 minute after exposure relative to a sensitivity of a sample developed at 10 second after exposure defined as 100.

The processing conditions for the evaluation are described below.

| Processing steps | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30~34° C. | 90 sec. |
| Drying | 60~80° C. | 60 sec. |

| | |
|---|---|
| Color developer | |
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catechol-3,5-disulfonic acid | 1.0 g |
| N-ethyl-N-β-methanesulfonamidoethyl-3-methyl-4-aminoaniline sulfate | 4.5 g |
| Brightening agent (4,4'-diaminostylbenedisulfonic acid derivative) | 1.0 g |
| Potassium carbonate | 27 g |
| Water was added to 1 liter, and the pH was adjusted to 10.10. | |
| Bleach-fixer | |
| Ammonium ferric ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water was added to 1 liter, and the pH was adjusted to 5.7 using potassium carbonate or glacial acetic acid. | |
| Stabilizer | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Brightening agent (4,4'-diaminostylbenedisulfonic acid derivative) | 1.5 g |

Water was added to 1 liter, and the pH was adjusted to 7.0 using sulfuric acid or potassium hydroxide. The evaluation results are shown below.

| Sample No. | Emulsion | Compound (I) | Iridium salt | Sensitivity | Reciprocity law | Stability of latent image |
|---|---|---|---|---|---|---|
| 101 (comparative) | Em-1 | — | No | 100 | 67 | 100 |
| 102 (comparative) | Em-2 | — | Yes | 90 | 81 | 10 |
| 103 (inventive) | Em-3 | I-3 | No | 115 | 79 | 98 |
| 104 (inventive) | Em-4 | I-9 | Yes | 119 | 83 | 102 |
| 105 (inventive) | Em-5 | I-15 | Yes | 125 | 84 | 101 |
| 106 (inventive) | Em-6 | I-3 | Yes | 118 | 87 | 98 |
| 107 (comparative) | Em-7 | IR-1 | Yes | 95 | 79 | 105 |
| 108 (comparative) | Em-8 | IR-2 | Yes | 45 | 80 | 106 |

As is apparent from the above results, the samples of the invention have high sensitivity, improved reciprocity law characteristics and latent image stability. In particular, the samples containing iridium salt have improved reciprocity law characteristics, but have disadvantages that sensitivity and latent image stability deteriorate. However, it can be seen that each of the samples of the invention has improved reciprocity law characteristics, with both sensitivity and latent image stability improved simultaneously.

Example 2

Em-9 and Em-10 were prepared in the same way as in Em-2 and Em-6, except that sodium thiosulfate, sodium chloroaurate, and SB-1 were used for chemical sensitization.

Sample Nos. 109 and 110 were formed by coating Em-9 and Em-10 on a support, respectively in the same way as in Em-1. Each of the samples was evaluated in the same way as in Example 1 and the results are as follows.

| Sample No. | Emulsion | Sodium chloroaurate | Compound (I) | Sensitivity | Reciprocity law characteristics | Stability of latent image |
|---|---|---|---|---|---|---|
| 106 (inventive) | Em-6 | No | I-3 | 118 | 87 | 98 |
| 110 (inventive) | Em-10 | Yes | I-3 | 242 | 86 | 102 |
| 102 (comparative) | Em-2 | No | — | 90 | 81 | 107 |
| 109 (comparative) | Em-9 | Yes | — | 198 | 75 | 113 |

The results show that sample No. 109 subjected to sensitization using sodium chloroaurate, in particular, has excellent sensitivity but poor reciprocity law characteristics. Also, the samples containing iridium have significantly poor reciprocity law characteristics and latent image stability. In the samples of the invention, it is clear that sensitivity and reciprocity law characteristics as well as maintenance of latent image stability are improved.

Example 3

The addition time of solutions A and B and that of solutions C and D in the preparation of EMP-1 of Example 1 were changed to prepare a monodispersed emulsion comprising cubic grains having an average grain size of 0.71 μm (length of edge of cube), a coefficient of variation of 0.07, and a silver chloride content of 99.9 mol %.

This emulsion was optimally sensitized at 65° C. by adding 0.8 mg/mol of AgX of sodium thiosulfate, $6\times10^{-4}$ mol/mol of AgX of SB-1, and $4\times10^{-4}$ mol/mol of AgX of sensitizing dye BS-1. The resulting blue-sensitive silver halide emulsion was designated Em-11. Note that $K_2IrCl_6$ was added to solution C in an amount of $1\times10^{-8}$ mol/mol of AgX.

Em-12 was prepared in the same way as in Em-11, except that I-3 was added to solution C in an amount of $1\times10^{-5}$ mol/mol of AgX.

Em-13 and Em-14 were prepared in the same way as in Em-11 and Em-12, respectively, except that sensitization was performed by adding 1.5 mg/mol of AgX of sodium chloroaurate.

The addition time of solutions A and B and that of solutions C and D in the preparation of EMP-1 of Example 1 were changed to form a monodispersed emulsion comprising cubic grains having an average grain size of 0.52 μm (length of edge of cube), a coefficient of variation of 0.07, and a silver chloride content of 99.9 mol %.

This emulsion was optimally sensitized at 67° C. by adding 2.0 mg/mol of AgX of sodium thiosulfate, $7\times10^{-4}$ mol/mol of AgX of SB-1, and $7\times10^{-5}$ mol/mol of AgX of sensitizing dye RS-1. The resulting red-sensitive silver halide emulsion was designated Em-15. Note that $K_2IrCl_6$ was added to solution C in an amount of $3\times10^{-8}$ mol/mol of AgX.

BS-1

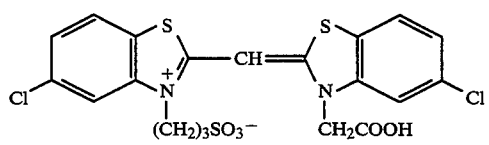

RS-1

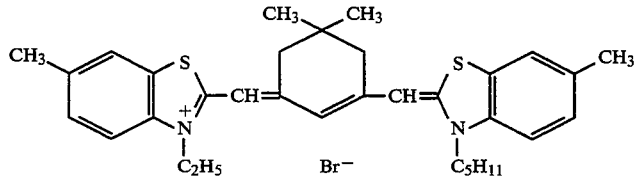

Em-16 was prepared in the same way as in Em-15, except that I-3 was added to solution C in an amount of $1.4\times10^{-5}$ mol/mol of AgX.

Em-17 and Em-18 were prepared in the same way as in Em-15 and Em-16, respectively, except that sensitization was performed by adding 0.3 mg/mol of AgX of sodium chloroaurate.

Layers with the following compositions shown in Tables 2 and 3 were formed by coating on a paper support having polyethylene lamination on one face and polyethylene lamination containing titanium oxide on the other (photographic composition layer side) to obtain a multilayered color light-sensitive sample No. 201.

The coating solutions were prepared as follows.

Coating solution for 1st layer

In 60 ml of ethyl acetate were dissolved 26.7 g of yellow coupler (Y-1), 10.0 g of dye-image stabilizer (ST-1), 6.67 g of ST-2, 0.67 g of additive (HQ-1), and 0.67 g of high-boiling organic solvent (DNP). The resulting solution was dispersed in 220 ml of a 10% aqueous gelatin solution containing 7 ml of a 20% surfactant (SU-1) using an ultrasonic homogenizer to obtain a yellow coupler dispersion. A fungicide (F-1) was added to the dispersion. This dispersion was mixed with the blue-sensitive emulsion Em-11 (containing 8.67 g of silver) to prepare the coating solution for the 1st layer.

The coating solutions for the 2nd through the 7th layers were prepared in the same way as in the coating solution for the 1st layer above. As hardener, H-2 was added to the 2nd and 4th layers, and H-1 was added to the 7th layer. As coating aid, surfactants (SU-2) and (SU-3) were added to adjust the surface tension.

TABLE 2

| Layer | Composition | Coating weight ($g/m^2$) |
|---|---|---|
| 7th layer | Gelatin | 1.00 |
| 6th layer (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistain agent (HQ-1) | 0.01 |
| | DNP | 0.20 |
| | PVP | 0.03 |
| | Anti-irradiation dye (AIC-1) | 0.02 |
| 5th layer (red-sensitive layer) | Gelatin | 1.30 |
| | Red-sensitive silver chlorobromide emulsion (Em-R) | 0.21 |
| | Cyan coupler (C-1) | 0.24 |
| | Cyan coupler (C-2) | 0.08 |
| | Dye-image stabilizer (ST-1) | 0.20 |
| | Antistain agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistain agent (HQ-1) | 0.03 |
| | DNP | 0.40 |

TABLE 3

| Layer | Composition | Coating weight ($g/m^2$) |
|---|---|---|
| 3rd layer (green-sensitive layer) | Gelatin | 1.40 |
| | Green-sensitive silver chlorobromide emulsion (Em-G) | 0.17 |
| | Magenta coupler (M-1) | 0.35 |
| | Dye-image stabilizer (ST-3) | 0.15 |
| | Dye-image stabilizer (ST-4) | 0.15 |
| | Dye-image stabilizer (ST-5) | 0.15 |
| | DNP | 0.20 |
| | Anti-irradiation dye (AIM-1) | 0.01 |
| 2nd layer (intermediate layer) | Gelatin | 1.20 |
| | Antistain agent (HQ-2) | 0.03 |
| | Antistain agent (HQ-3) | 0.03 |
| | Antistain agent (HQ-4) | 0.05 |
| | Antistain agent (HQ-5) | 0.23 |
| | DIDP | 0.06 |
| | Fungicide (F-1) | 0.002 |
| 1st layer (blue-sensitive layer) | Gelatin | 1.20 |
| | Blue-sensitive silver chlorobromide emulsion (Em-B) | 0.26 |
| | Yellow coupler (Y-1) | 0.80 |
| | Dye-image stabilizer (ST-1) | 0.30 |
| | Dye-image stabilizer (ST-2) | 0.20 |
| | Antistain agent (HQ-1) | 0.02 |
| | DNP | 0.20 |
| | Anti-irradiation dye (AIY-1) | 0.01 |
| Support | Polyethylene laminated paper | |

The coating weight of silver halide emulsion is the amount converted to silver.

HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonylbutyl)hydroquinone
ST-1: 2,4-di-t-pentyl-(4-hydroxy-3,5-di-t-butyl)benzoate
ST-2: 2,4-di-t-pentyl-diethylcarbamoylmethoxybenzene
HBS-1: 1-dodecyl-4-(p-toluenesulfonamido)benzene
DNP: Diphenyl phthalate
DIDP: Di-i-decylphthalate
PVP: Polyvinyl pyrrolidone
SU-1: Di(2-ethylhexyl) sulfosuccinate sodium
SU-2: SOdium tri-isopropylnaphthalene sulfonate
SU-3: Di(2,2,3,3,4,4,5,5-octafluoropentyl) sulfosuccinate sodium
F-1: 2-methyl-5-chloro-4-isothiazoline-3-one
H-2: Tetrakis(vinylsulfonylmethyl)methane

Y-1:

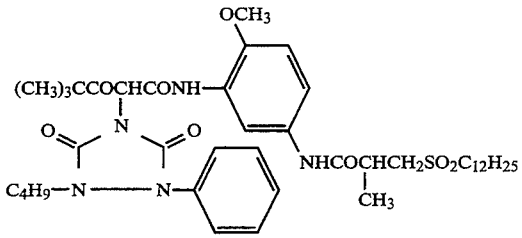

C-1

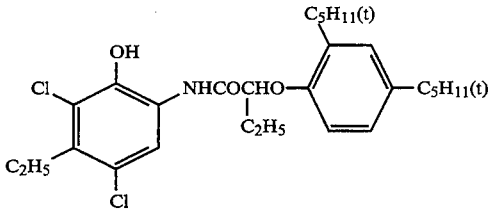

-continued
C-2
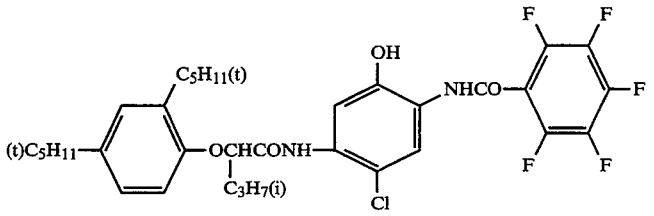
UV-1
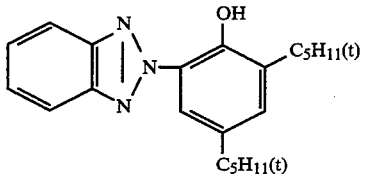
UV-2
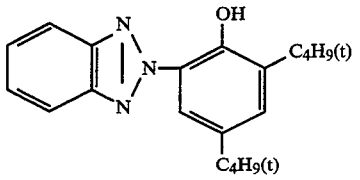
UV-3
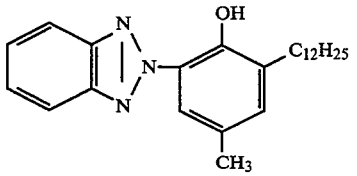
AIY-1
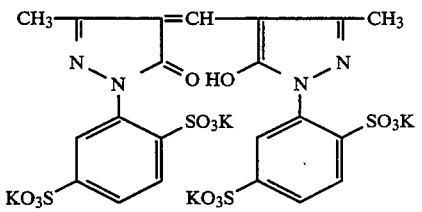
AIM-1
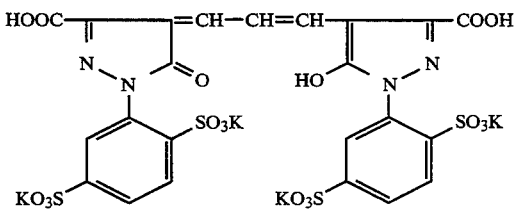
AIC-1
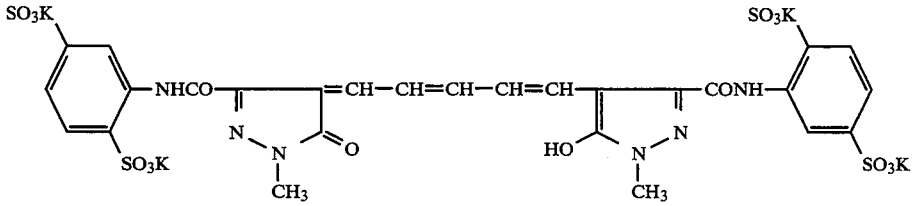
Sample Nos. 202 to 204 were prepared in the same way as in sample No. 201, except that the emulsions used in the light-sensitive emulsion layers were changed to those given in Table 4.
TABLE 4
| Sample No. | Emulsion layer: Blue-sensitive Em-B | Green-sensitive Em-G | Red-sensitive Em-R | Compound (1) | Sensitization* |
|---|---|---|---|---|---|
| 201 (comparative) | Em-11 | Em-2 | Em-15 | — | No |
| 202 (inventive) | Em-12 | Em-6 | Em-16 | I-3 | No |

TABLE 4-continued

| Sample No. | Emulsion layer Blue-sensitive Em-B | Green-sensitive Em-G | Red-sensitive Em-R | Compound (1) | Sensitization* |
|---|---|---|---|---|---|
| 203 (comparative) | Em-13 | Em-9 | Em-17 | — | Yes |
| 204 (inventive) | Em-14 | Em-10 | Em-18 | I-3 | Yes |

*Sensitization using sodium chloroaurate.

Sample Nos. 201 to 204 were exposed and processed in the same way as in Example 1, except that blue-, green-, and red filter were used during exposure. Then, the samples were evaluated in the same way as in Example 1. The sensitivity of the samples was expressed relative to a sensitivity of sample No. 201 defined as 100. The fog density of layer, which was measured using the optical densitometer PDA-65 (product of Konica Corp.), was expressed relative to that of the corresponding color-sensitive layer of sample No. 201. The obtained results are given below.

| Sample No. | Layer | Sensitivity | Reciprocity law characteristics | Stability of latent image | Fog |
|---|---|---|---|---|---|
| 201 (comparative) | Blue-sensitive | 100 | 81 | 108 | 0.00 |
| | Green-sensitive | 100 | 80 | 107 | 0.00 |
| | Red-sensitive | 100 | 79 | 106 | 0.00 |
| 202 (inventive) | Blue-sensitive | 137 | 86 | 101 | 0.00 |
| | Green-sensitive | 132 | 87 | 98 | 0.00 |
| | Red-sensitive | 135 | 87 | 100 | 0.01 |
| 203 (comparative) | Blue-sensitive | 190 | 79 | 110 | 0.02 |
| | Green-sensitive | 198 | 80 | 113 | 0.02 |
| | Red-sensitive | 190 | 81 | 109 | 0.02 |
| 204 (inventive) | Blue-sensitive | 217 | 85 | 99 | 0.01 |
| | Green-sensitive | 220 | 86 | 102 | 0.01 |
| | Red-sensitive | 224 | 86 | 101 | 0.00 |

As is apparent from the above results, it is verified that the invention is effective even for multilayered color light-sensitive materials. Sample No. 204 of the invention chemically sensitized using sodium chloroaurate, in particular, shows marked improvement in reciprocity law characteristics and latent image stability with high sensitivity compared to those of comparative sample No. 203 sensitized using the same compound.

That is, samples chemically sensitized using sodium chloroaurate exhibit satisfactory improvements in reciprocity law characteristics, latent image stability, and offer high sensitivity.

Example 4

Emulsions comprising individual grains having a localized silver bromide phase on its surface were prepared according to Japanese Patent O.P.I. Publication No. 183647/1989.

After adding 6 g of sodium chloride to a 3% aqueous gelatin solution kept at 50° C., a solution containing 10 g of silver nitrate and that containing 3.44 g of sodium chloride were added thereto while being vigorously stirred. Then, to the resulting mixture, a solution containing 232 g of silver nitrate and that containing 79.8 g of sodium chloride were added, followed by addition of 290 mg of sensitizing dye GS-1. After stirring this mixture for 15 minutes, an aqueous solution containing 8 g of silver nitrate and a solution containing 0.55 g of sodium chloride and 0.5 g of potassium bromide were added at 40° C. while being vigorously stirred. The mixture was desalinized, washed, and redispersed in the same way as in EMP-1 in order to obtain an emulsion comprising grains having an average grain size of 0.40 μm and a coefficient of variation of 0.07. Results of X-ray diffraction measurements revealed formation of grains having localized silver bromide phase since the main peak appeared in correspondence with 100 mol % silver chloride and the secondary peak in correspondence with 60 to 90 mol % silver chloride.

This emulsion was optimally chemically sensitized using sodium thiosulfate, sodium chloroaurate, and the foregoing SB-1. The so-obtained emulsion was called Em-19. Note that during the preparation of Em-19, compound No. I-3 and $K_2IrCl_6$ were added respectively in the same amount as that added in Em-6 to the solution containing 79.8 g of sodium chloride.

As described below, Em-21 was chemically sensitized in the same as in Em-19, except that during grain formation the potassium bromide content was changed. Also, Em-20 and Em-22 were prepared in the same way as in Em-10, except that the bromide content was changed. Further, emulsions chemically sensitized in the same way as in Em-19 were formed.

Em-23 and Em-24 were prepared in the same way as in Em-19 and Em-22, respectively, except that 1-15 was added instead of I-3.

Sample Nos. 205 to 210 were prepared by coating these emulsions and were evaluated in the same as in Example 1. The results are as follows.

| Sample No. | Emulsion | Localized Br phase | Br content (mol %) | Sensitivity | Reciprocity law characteristics | Latent image stability |
|---|---|---|---|---|---|---|
| 205 (inventive) | Em-19 | Yes | 0.3 | 324 | 86 | 99 |
| 206 (inventive) | Em-20 | No | 0 | 240 | 85 | 102 |
| 207 (inventive) | Em-21 | Yes | 3.0 | 316 | 82 | 97 |
| 208 (inventive) | Em-22 | No | 0.3 | 246 | 83 | 103 |
| 209 (inventive) | Em-23 | Yes | 0.3 | 320 | 84 | 98 |
| 210 (inventive) | Em-24 | No | 0.3 | 220 | 79 | 95 |

A comparison of sample No. 205 with sample No. 208 showed that the emulsion having a localized bromide phase, in particular, markedly brings out the effect of the invention, and the emulsion having a Br content of 0.3 mol % has far more excellent sensitivity and improved reciprocity law characteristics.

Evaluation of sample No. 209 and sample No. 210 revealed that addition of thallium is as effective as the invention only for the silver halide emulsion having a localized Br phase.

What is claimed is:

1. A silver halide photographic light-sensitive material comprising a support and provided thereon, a silver halide emulsion layer comprising sliver halide grains containing silver bromochloride having a silver chloride content of 95 mol % or more and wherein said grains contain at least one substance selected from the group consisting of gallium, germanium, and compounds thereof.

2. The material of claim 1, wherein 60% or more of the silver halide grains in the emulsion layer contain at least one substance selected from the group consisting of gallium, germanium, and compounds thereof.

3. The material of claim 1, wherein 80% or more of the silver halide grains in the emulsion layer contain at least one substance selected from the group consisting of gallium, germanium, and compounds thereof.

4. The material of claim 1, wherein the grains contain a phase having a silver bromide content of 10 to 90 mol %.

5. The material of claim 1, wherein the grains contain $10^{-9}$ to $10^{-3}$ mol of the substance per mol of silver.

6. The material of claim 1, wherein the grains contain $10^{-9}$ to $10^{-3}$ mol of gallium or a compound thereof per mol of silver.

7. A silver halide photographic light-sensitive material comprising a support and provided thereon, a silver halide emulsion layer comprising silver halide grains containing $10^{-9}$ to $10^{-3}$ mol of germanium or a compound thereof per mol of silver.

8. The material of claim 7, wherein the grains comprise silver bromochloride having a silver halide content of 95 mol % or more.

9. The material of claim 7, wherein 60% or more of the silver halide grains in the emulsion layer contain germanium or a compound thereof.

10. The material of claim 9, wherein the grains contain a phase having a silver bromide content of 10 to 90 mol %.

11. A method for manufacturing a silver halide photographic light-sensitive material comprising a support and provided thereon, a silver halide emulsion layer comprising silver bromochloride grains having a silver chloride content of 95 mol % or more, comprising the step of forming the grains in the presence of at least one substance selected from the group consisting of gallium, germanium and compounds thereof.

12. The method of claim 11, wherein the grains are formed in the presence of $10^{-9}$ to $10^{-3}$ mol of the substance per mol of silver halide.

13. The method of claim 11, further comprising the step of conducting sulfur sensitization and gold sensitization of the grains.

14. The method of claim 11, wherein the grains are formed in the presence of an iron salt or an iridium salt.

15. A method for manufacturing a silver halide photographic light-sensitive material comprising a support and provided thereon, a silver halide emulsion layer containing silver halide grains, comprising the step of forming the grains in the presence of $10^{-9}$ to $10^{-3}$ mol of germanium or a compound there per mold of silver halide.

16. The method of claim 15, further comprising the step of conducting sulfur sensitization and gold sensitization of the grains.

* * * * *